US006878016B2

(12) United States Patent
Wulff et al.

(10) Patent No.: US 6,878,016 B2
(45) Date of Patent: Apr. 12, 2005

(54) HIGH CYCLE CONNECTOR CONTACT SYSTEM

(75) Inventors: Thomas Wulff, North Patchogue, NY (US); David E. Bellows, Holbrook, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 0 days.

(21) Appl. No.: 10/317,452

(22) Filed: Dec. 12, 2002

(65) Prior Publication Data

US 2004/0115994 A1 Jun. 17, 2004

(51) Int. Cl.[7] ..... H01R 13/24
(52) U.S. Cl. ..... 439/700; 439/824
(58) Field of Search ..... 439/700, 824, 439/180, 660, 626, 816, 819, 775

(56) References Cited

U.S. PATENT DOCUMENTS 3,431,428 A * 3/1969 Valer ..... 307/10.1
4,734,050 A * 3/1988 Negre et al. ..... 439/289
5,542,015 A * 7/1996 Hultermans ..... 385/60
5,749,754 A * 5/1998 Patterson et al. ..... 439/824
6,039,580 A * 3/2000 Sciarretta et al. ..... 439/63
6,261,130 B1 * 7/2001 Huynh et al. ..... 439/700
6,280,258 B1 * 8/2001 Frohlund ..... 439/700
6,450,828 B1 * 9/2002 Gordon ..... 439/347
6,653,562 B2 * 11/2003 Kochanski et al. ..... 174/50
2001/0046801 A1 * 11/2001 Tate et al. ..... 439/181
2003/0220022 A1 * 11/2003 Kawaguchi et al. ..... 439/633
2004/0002243 A1 * 1/2004 Mellott et al. ..... 439/180

OTHER PUBLICATIONS

International Search Report, PCT/US03/35766, mailed May 20, 2004.

* cited by examiner

*Primary Examiner*—Michael C. Zarroli
(74) *Attorney, Agent, or Firm*—Amin & Turocy, LLP

(57) ABSTRACT

A connector contact interface system for a portable device. The system includes a first arrangement of one or more fixed electrically conductive contacts of a first device, and a second arrangement of one or more electrically conductive pogo contacts in a second device, which pogo contacts of the second device are in substantially axial alignment with the respective fixed contacts of the first arrangement of the first device. When the connectors are in full engagement, the one or more pogo contacts and the respective one or more fixed contacts are in tip-to-tip abutment. The first arrangement is included either on a rigid or flexible circuit board or in connector housing of the first device, and the second arrangement is included in a connector housing of the second device. The contacts of either or both of the first and second arrangements are plated with a wear-resistant metal such as hard gold.

22 Claims, 9 Drawing Sheets

HIGH CYCLE CONNECTOR CONTACT SYSTEM

TECHNICAL FIELD

This invention is related to interface connectors, and more specifically, to the contact mechanism employed therein.

BACKGROUND OF THE INVENTION

A connector interface of a terminal is a critical component of overall system design, since the interface connector can be utilized for transmitting data between a host of accessories, and can also act as a power conduit for providing power to, for example, a battery-powered device during charging of an on-board battery.

When exposed to rugged and dirty environments, the connector interface system is often a weakest link in maintaining power and signals to the device. For example, routine use of a portable or handheld device that operates in a base station configuration often requires removal from and replacement (e.g., a cycle) into the base station or charging unit when not in use and/or when charging is needed. Such systems can experience high cycle applications where the device is removed and replaced significantly over the device's lifetime.

A connector interface system of a device/station pair typically includes two mating connectors, e.g., one connector on the device and its mating connector in the station. Each connector comprises one or more plated contacts that when utilized on the device that is repeatedly cycled with the base station, the contacts exhibit a wearing-away of the contact plating. The plating wear is a common problem in a conventional system that is usually caused by the repeated wiping action of the pin (or male) contact against the socket (or female) contact. In industrial applications where the interface connectors will be mated and unmated in excess of 100,000 times, particularly in transportation and logistics, contact wear is a major problem operating to degrade the connection and overall usefulness of the device.

Referring initially to the drawings, FIG. 1 illustrates an isometric of a conventional connector pair assembly 100 that utilizes the wiping form of contact. A female connector assembly 102 is designed for compatible interface to a male connector assembly 104. The female connector 102 includes a number of female contacts 106 that come into operative contact with respective male contacts 108 of the male connector 104 when the connectors 102 and 104 are engaged. The male contact 108 includes a bend feature 110 that is designed to enter into (and out of) contact with its respective female contact 106 by sliding along the corresponding female contact 106 when the connectors 102 and 104 are engaged (and disengaged). Thus the bend feature 110 coming into contact with the respective female contact during engagement and disengagement of the connectors 102 and 104 forms the wiping action on the metals of the two contacts 106 and 108 that in high cycle applications eventually wears away the contact plating on the surface on either or both of the contacts 106 and 108.

Referring now to FIG. 2, there is illustrated a side view of the conventional connector pair of FIG. 1 incorporating the wiping style of contact. The male connector 104 includes the male contact 108 with the bend feature 110, and further, a contact lug 200 for permanently connecting a suitable wire thereto. The female connector 102 includes the corresponding female contact 106 integrated therein such that when the connectors 102 and 104 are brought into engagement, an upper surface 112 of the bend feature 110 slidably engages a lower surface 202 of the female contact 106 for a short distance along the length of the female contact 106 to facilitate an electrical connection. This wiping action causes metal plating wear during the engagement process. Of course, contact wear also occurs in the reverse operation, since the contacts move along one another when the connectors 102 and 104 are disengaged. The wear associated with such wiping action contact design can be greatly reduced or even eliminated if a tip-to-tip contact design was implemented. Note that the illustrations of FIG. 1 and FIG. 2 are not necessarily to scale, or to a particular design, but are intended to simply show the general features of the wiping form of contacts in a conventional connector pair.

Alignment of the male and female connectors is also a common problem, particularly in pin-in-socket type connectors. Because of the intolerant stack-up associated with the terminal assembly and connector itself, compounded with a similar stack-up on the accessory side, alignment of the connector halves can be a serious issue. Pin-in-socket type connectors have the most significant alignment issue; if the pins and sockets are not accurately lined up, pins can be bent and/or broken off as the user attempts to force the two mating connector halves together.

Referring now to FIG. 3, there is illustrated an isometric of a conventional pin-in-socket type of connector assembly. A male connector assembly 300 is manufactured with one or more pin contacts 302, and a compatible female connector assembly 304 includes one or more corresponding socket contacts 306. When the connectors 300 and 304 are moved into engagement, the pin contacts 302 slide into respective socket contacts 306 to facilitate an electrical connection. However, misalignment of any pin contact 302 to any socket contact 306 can cause the user to twist or struggle with the connectors 300 and 304 in an attempt to align all of the pins to the respective sockets for full engagement of the connectors 300 and 304. Such a system not only is susceptible to the alignment problem, but also contends with the contact plating wear problem associated with the wiping form of contact.

Referring now to FIG. 4, there is illustrated a side view of the conventional connector pair of FIG. 3 that incorporates the pin-in-socket style of contacts. The male connector 300 includes the plated pin contact 302, which pin contact 302 includes a pin head portion 400 that slides into a corresponding plated socket slot 402 of the socket contact 306 of the female connector 304. This design is also burdened with wear of the contact plating on a surface 404 of the pin head portion 400 that comes into contact with an inside surface(s) 406 of the socket slot 402, since the wiping action is present between the pin head portion 400 and the inside surface(s) 406. Of course, the inside surface(s) 406 of the socket slot 402 also exhibit plating wear in high cycle applications, which reduces the lifetime of the device in which such contact style is used.

Alignment becomes even more of an issue with the pin-in-socket style of contacts, since repeated use in high cycle applications can cause one or more pins to bend out of alignment with the respective female socket 402. Furthermore, connector housing wear can be a factor in misalignment of the pins to the sockets. Still further, the more contacts in the connector assembly, the more difficult it is to ensure that all contacts are properly aligned to make the electrical connection. The wear associated with such wiping action, and alignment issues with the pin-in-socket contact design can be greatly reduced or even eliminated if a tip-to-tip contact design was implemented.

What is needed is a more reliable interface connector system for use in high cycle applications that utilizes a contact interface design that minimizes contact wear and alignment issues.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention disclosed and claimed herein, in one aspect thereof, comprises a connector interface for a portable device. The portable device interface includes an interface connector having an arrangement of one or more pogo-style contacts to facilitate conducting power and signals. Wearing of the pogo contacts and mating contacts of an accessory to which the portable device interfaces, is reduced substantially during engagement and disengagement of the portable device with the accessory. The portable device can include either the male component of the connector interface or the female component depending upon design choice, and the related accessory device include the counterpart component of the connector interface. Employment of such interface connector as part of the portable device facilitates extending device life-time and/or maintenance to the extent that such interface component exhibits less wear and tear than conventional connector interfaces currently employed in portable devices.

In another aspect thereof, there is provided a connector contact interface system for a portable device and an accessory. The portable device includes a device connector having a first arrangement of one or more pogo contacts. The accessory includes an accessory connector adapted to mate to the device connector, the accessory connector having a second arrangement of accessory contacts that align with the one or more pogo contacts of the device connector. Wearing of the device contacts and accessory contacts is reduced substantially during engagement and disengagement of the portable device with the accessory because the device and accessory contacts are configured to be in axial alignment. When the connectors are in full engagement, they are axially aligned in tip-to-tip abutment. The device and/or the accessory contacts are included either on a rigid or flexible circuit board, or in connector housing. The contacts of either or both of the connectors are plated with a wear-resistant metal such as hard gold.

In still another aspect thereof, there is provided an accessory for the portable device adapted to interface thereto in accordance with the disclosed connector interface architecture. The accessory includes an arrangement of one or more pogo contacts for conducting at least one of power and signals. The one or more pogo contacts are in substantially axial alignment and tip-to-tip abutment with mating contacts of the portable device during engagement of the accessory with the portable device. The pogo contacts plated with a wear-resistant electrically conductive hard gold. The accessory is operable to communicate signals wirelessly with the portable device during disengagement.

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention may become apparent from the following detailed description of the invention when considered in conjunction with the drawings.

DETAILED DESCRIPTION OF THE INVENTION

Figure 1:
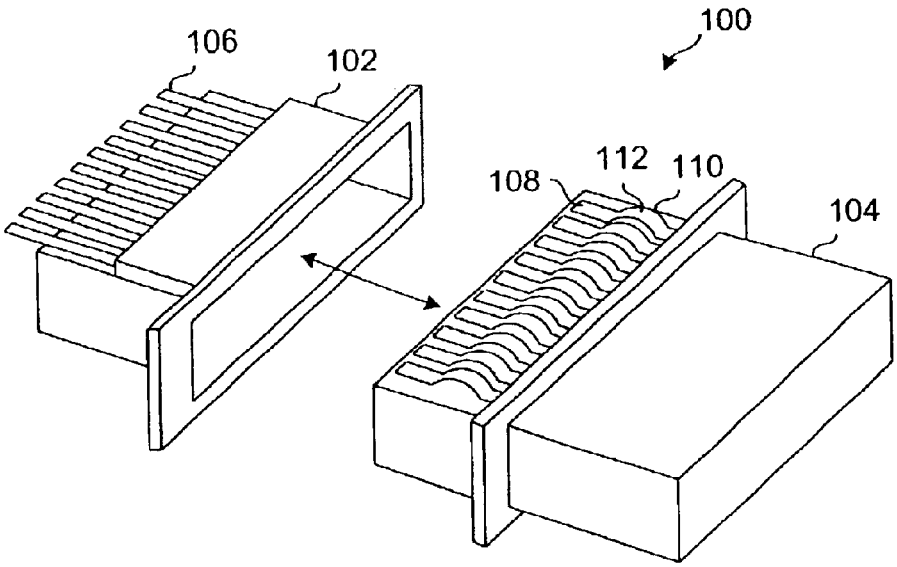
FIG. 1 (Prior Art)
FIG. 1 illustrates an isometric of a conventional connector pair assembly that utilizes the wiping form of contact.
Figure 2:
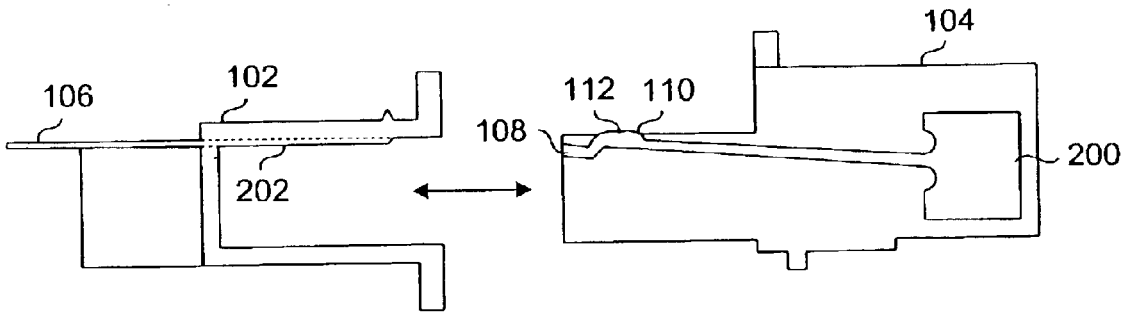
FIG. 2 (Prior Art)
FIG. 2 illustrates a side view of the conventional connector pair of FIG. 1 incorporating the wiping style of contact.
Figure 3:
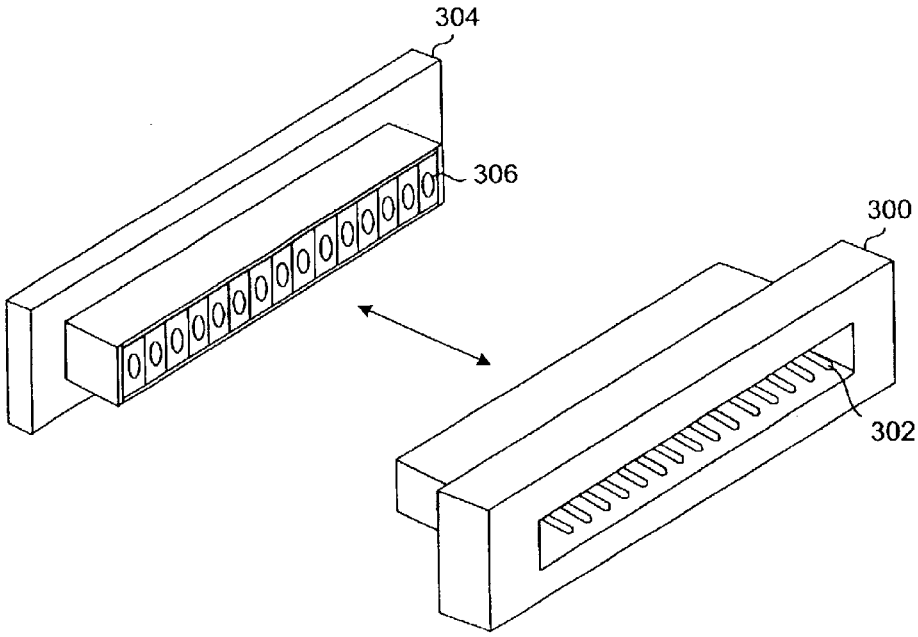
FIG. 3 (Prior Art)
FIG. 3 illustrates an isometric of a conventional pin-in-socket type of connector assembly.
Figure 4:
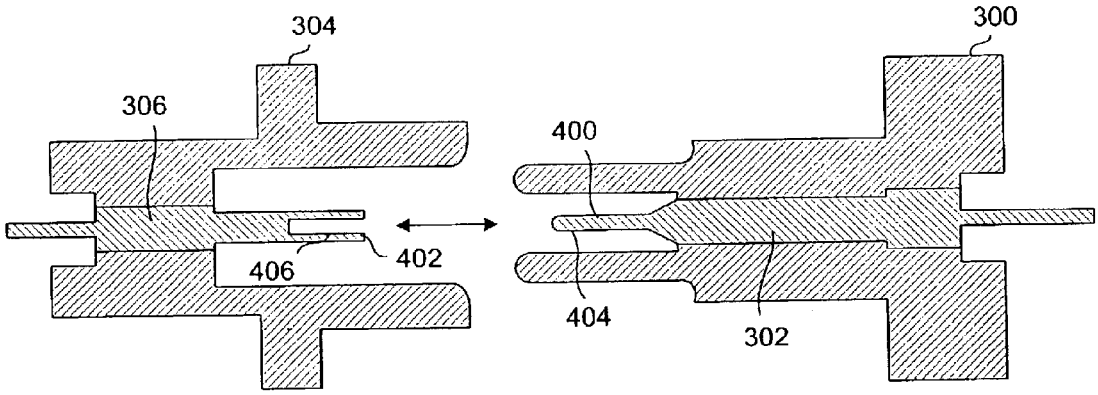
FIG. 4 (Prior Art)
FIG. 4 illustrates a side view of the conventional connector pair of FIG. 3 that incorporates the pin-in-socket style of contact.

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The disclosed invention provides a reliable tip-to-tip contact connector interface system for use in high cycle applications that substantially eliminates alignment and contact wear issues in connection with portable computing devices (e.g., mobile terminals). Suitable application of the connector system includes a wide variety of portable devices that interface with a base unit or station, such as handheld terminals, portable optical scanning devices, portable magnetic data readers, wireless telephones, and virtually any application requiring the interface of two set of opposing contacts.

Figure 5:
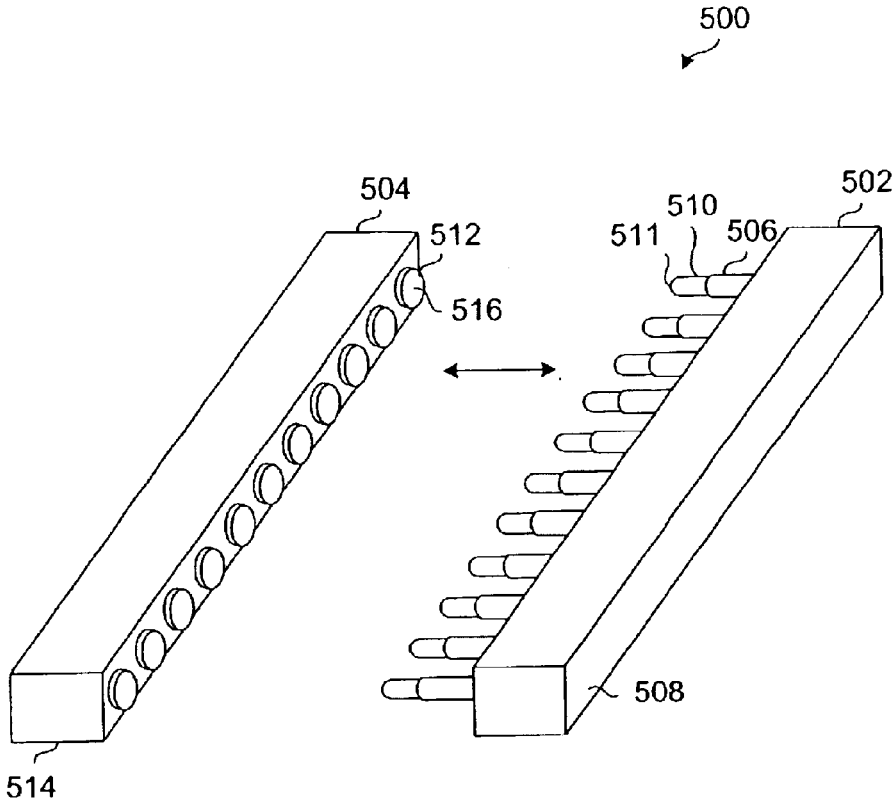
FIG. 5 illustrates an isometric of an exemplary connector system, according to a disclosed embodiment.

Referring now to FIG. 5, there is illustrated an isometric of an exemplary connector system 500, according to a disclosed embodiment. The system 500 includes both a male connector 502 and a female connector 504, each having an arrangement of electrically conductive contacts manufactured therein suitable for making an appropriate electrical connection according to the particular application. In this preferred embodiment, the male connector 502 includes pin contacts 506 of a pogo style (e.g., a compressible recoilable spring probe or plunger) assembled in a predetermined arrangement within a plastic housing block 508. The pogo contact 506 includes a head portion 510 with a tip 511 that comes into a tip-to-tip abutment with a corresponding female contact 512, when the connectors 502 and 504 are in full engagement. The female contact 512 is intentionally oversized to allow for any misalignment that may occur. Thus the traditional alignment pegs that typically accompany either or both of the connectors (502 and 504) are not required. Both the pogo contact 506 and the female contact 512 include a lug end (not shown) for connecting a wire or circuit track by crimping, soldering, or other techniques known to make such connections, to the device into which it is designed. Here, the female contacts 512 (or a series of posts) are a fixed style of contact (e.g., non-pogo style) that is assembled into a plastic housing connector block 514. To promote a more reliable connection, a contact end 516 of the female contact 512 may have a wide exposed surface such that alignment with the tip 511 of the male head portion 510 is substantially assured during full engagement of the connectors 502 and 504. This is illustrated in greater detail hereinbelow.

The connector system 500 is suitable for high cycle applications by offering a simple axial motion for this tip-to-tip contact style when mating the connectors 502 and 504, which substantially reduces or eliminates alignment issues and plating wear for a high cycle life on the order of 100,000 insertion actions. That is, the user is assured of an operational electrical connection for each pin/pad pair when engaging the connectors 502 and 504 since there are no significant alignment issues and no substantial contact wear. The contacts of both connector halves can be plated with a suitable wear-resistant electrically conductive hard metal material such as hard gold, which reduces or virtually eliminates the need for contact cleaning.

Is it appreciated that the either or both of the connectors 502 and 504 can contain pogo-style contacts. However, to keep costs low, it is preferable that only one of the connectors contains the pogo-type contacts, that being the male connector. Furthermore, where the application may find such a use, all the pogo contacts can be of one type, or a combination of different types of pogo contacts in the same connector.

Figure 6:
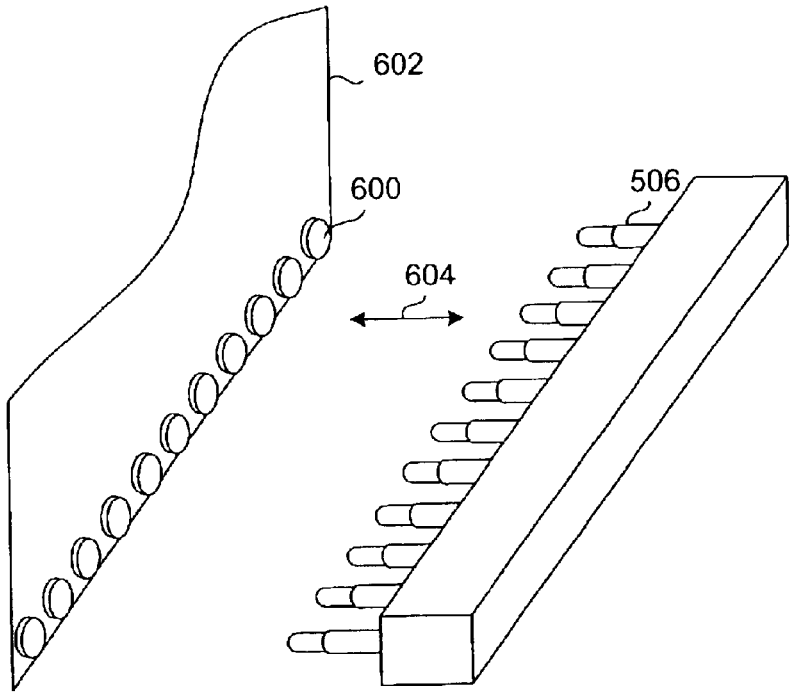
FIG. 6 illustrates an alternative embodiment in which the female contacts are configured simply as an arrangement of the fixed conductive contact pads on a rigid circuit board (or flexible circuit board).

Referring now to FIG. 6, there is illustrated an alternative embodiment in which the female contacts 512 are configured simply as an arrangement of the fixed conductive contact pads 600 on a rigid circuit board 602 (or flexible circuit board). In such an implementation, the pads 600 can be on an exposed portion of the circuit board of the portable device, such that when returned to the base station, cradle, or mating accessory, the portable device is situated to bring the pads 600 into an axial alignment 604 and tip-to-tip contact with the male connector pogo-style pin contacts 506.

Figure 7:
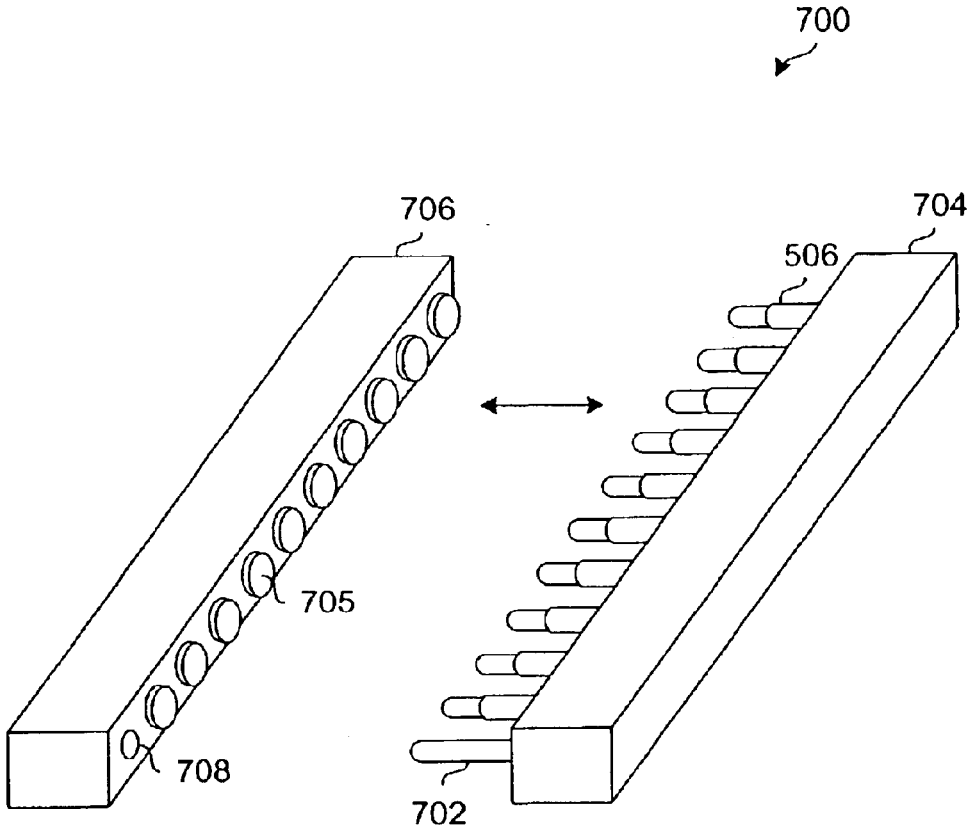
FIG. 7 illustrates an alternative embodiment in which the connector system of FIG. 5 includes a mixed arrangement of one or more pogo-style pins and one or more non-pogo pins.

Referring now to FIG. 7, there is illustrated an alternative aspect in which a connector system 700 (similar to connector system 500) includes a mixed arrangement of one or more of the pogo-style contacts 506 and corresponding oversized female contacts 705. One or more non-pogo pins (or pegs) 702 are also included in this implementation, but are not required. For example, a male connector 704 includes the non-pogo pin 702 that is an alignment peg that matches with a peg socket (or hole) 708 of a female connector 706 so that the user can more readily engaged the connectors 704 and 706. Of course, other quick alignment connect or disconnect designs can be utilized in combination with the disclosed connector system 700 according to the particular application. The disclosed connector system is not limited to all pogo-style contacts 506, but can include an arrangement of one or more of the guide pegs 702, one or more fixed pin connections, etc., with the pogo-style pins 506.

Figure 8:
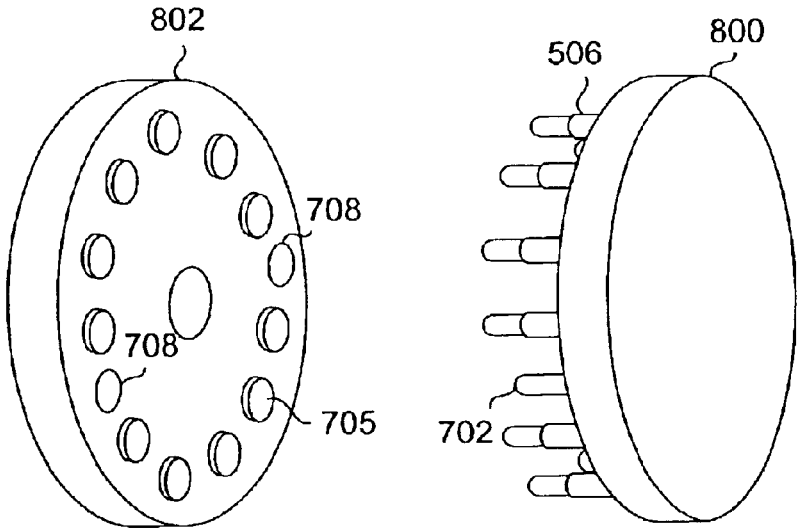
FIG. 8 illustrates an alternative embodiment in which the connectors are circular in design, utilizing the disclosed interface system of FIG. 5.

Referring now to FIG. 8, there is illustrated an alternative aspect in which a connector pair is circular in design, utilizing the disclosed interface system of FIG. 5. A circular male connector 800 includes a mixed arrangement of one or more of the pogo-style contacts 506, corresponding oversized female contacts 705, and one or more non-pogo pins (or pegs) 702. In this particular aspect, the male connector 800 includes two non-pogo pins 702 (one not visible) that are alignment pegs matching with the respective peg sockets (or holes) 708 of a circular female connector 802, so that the user can more readily engaged the connectors 800 and 802. As indicated hereinabove, however, this circular connector arrangement does not need to use the alignment pegs 702, since the use of the oversized female contacts 705 will compensate for any misalignment. Of course, other quick alignment connect or disconnect designs can be utilized in combination with the disclosed circular connector system according to the particular application. The disclosed circular connector system is not limited to all pogo-style contacts 506, but can include an arrangement of one or more of the guide pegs 702, one or more fixed pin connections, etc., with the pogo-style pins 506.

Figure 9:
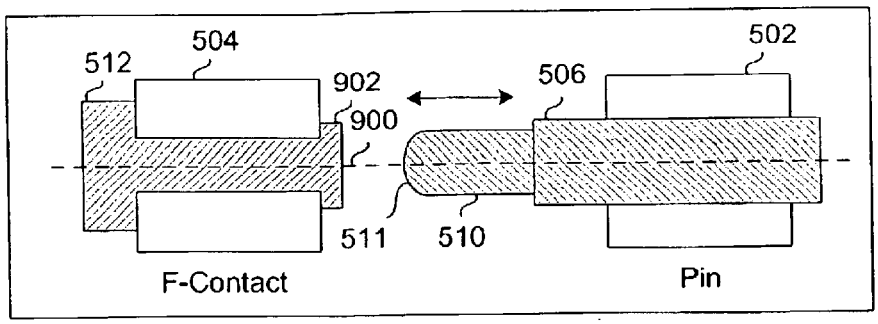
FIG. 9 illustrates a more detailed view of the relationship between the pogo-style pin and corresponding female contact for the connector system of FIG. 5.

Referring now to FIG. 9, there is illustrated a more detailed view of the relationship between the pogo-style pin 506 (denoted "Pin" in the illustration) and corresponding female contact 512 (denoted "F-Contact" in the illustration) for the connectors 502 and 504 of FIG. 5. The location of the pin 506 is designed into the male connector 502 to be in substantial axial alignment with the corresponding female contact 512. Ideally, the female contact 512 and the pogo pin 506 are in axial alignment along a common central axis 900. However, in operation, repeated cycling of the device with the base station or whatever the mating apparatus may be for the device, can cause wear in the connector assemblies or mating apparatus resulting in the head portion 510 (of the pogo pin 506) and female contact 512 becoming slightly misaligned. To prevent misalignment that can result in a total electrical disconnect between the pin head portion 510 and the female contact 512, the female contact 512 includes an oversized female contact head 902 (similar to contact end 516) whose contact surface area is sized equally or larger than the area of the pin head portion 510 to compensate for any misalignment along the axis 900 that may occur due to the high cycle lifetime. Thus the pin head tip 511 is assured of coming into tip-to-tip abutment with the contact head 902 of the female contact 512 when connectors 502 and 504 are engaged. Note that in this particular embodiment, the head portion 510 has the tip 511 that is rounded to facilitate a single-point electrical connection no matter how misaligned the connectors 502 and 504 could be. Therefore, using the disclosed connector system architecture substantially eliminates the metal-to-metal wiping action exhibited in the prior art. Note also that the head configurations of the pogo style pin 506 and female contact head 902 can be reversed such that the flatter style of female contact head 902 is part of the pogo pin 506, and the round tip 511 is utilized on the female contact 512.

Figure 10:
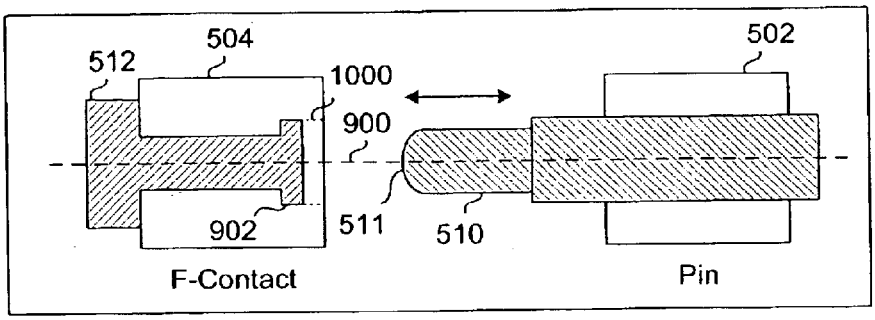
FIG. 10 illustrates a detailed view of an alternative embodiment where the head portion of the female contact used for contacting the pin head is recessed into the housing of the female connector.

Referring now to FIG. 10, there is illustrated a detailed view of an alternative embodiment where the contact head 902 of the female contact 512 used for contacting the pin head portion 510 is recessed into the housing of the female connector 504. The contact head 902 is recessed into a recess 1000 of the housing of the connector 504 to facilitate guiding the pin head tip 511 into tip-to-tip contact with the contact head 902. For example, if the pin head portion 510 is slightly misaligned along the axis 900, the walls of the recess 1000 function to guide (or "funnel") the tip 511 into contact with the recessed female contact head 902. Since the housing of the female connector 504 is typically constructed of a hard plastic, or the like, the metal plating of the pin head portion 510 will not be worn away from the wiping action of the head portion 510 against the plastic walls of the recess. Again, note that the head portion 510 has the rounded tip 511 to facilitate a single-point electrical connection no matter how misaligned the connectors 502 and 504 could be. This is to illustrate that the disclosed architecture can be implemented in a number of ways, even with recessed and oversized female contact heads 902.

Figure 11:
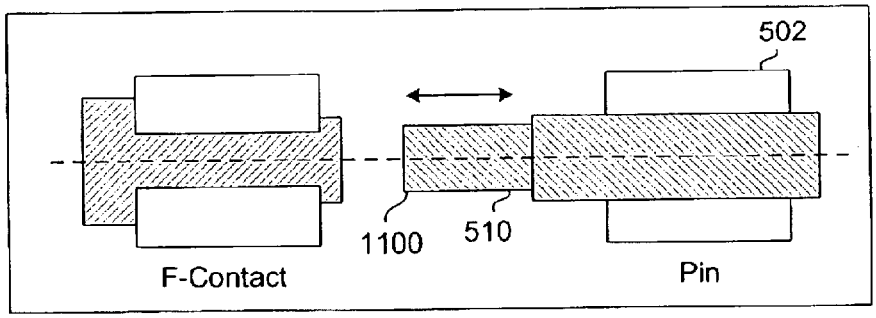
FIG. 11 illustrates a detailed view of an alternative embodiment where the pogo-style pin has a flat tip.

Referring now to FIG. 11, there is illustrated a detailed view of an alternative embodiment where the pogo-style pin 506 has a flat tip 1100. This is simply to indicate that the male connector 502 of disclosed connector system is not limited to a particular style of pogo pin.

Figure 12:
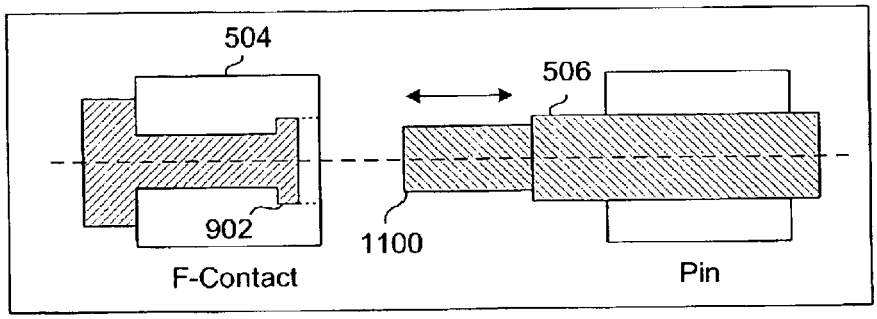
FIG. 12 illustrates a detailed view of an alternative embodiment where the where the pogo-style pin has the flat tip and the female contact head is recessed into the housing of the female connector.

Referring now to FIG. 12, there is illustrated a detailed view of an alternative embodiment where the pogo-style pin 506 has the flat tip 1100 and the female contact head 902 is recessed into the housing of the female connector 504. Again, this is simply to indicate that the female connector 504 of disclosed connector system is not limited to a particular style or design of fixed female contact 512.

Figure 13:
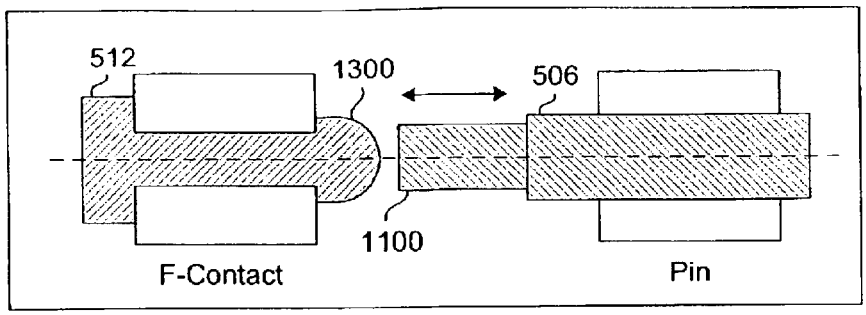
FIG. 13 illustrates a detailed view of an alternative embodiment where the pogo-style pin has the flat tip and the fixed female contact has a rounded head.

Referring now to FIG. 13, there is illustrated a detailed view of an alternative embodiment where the pogo-style pin 506 has the flat tip 1100 and the fixed female contact 512 has a rounded head 1300. This is simply to indicate that the female connector 504 of disclosed connector system is not limited to a particular style or design of fixed female contact 512.

Figure 14:
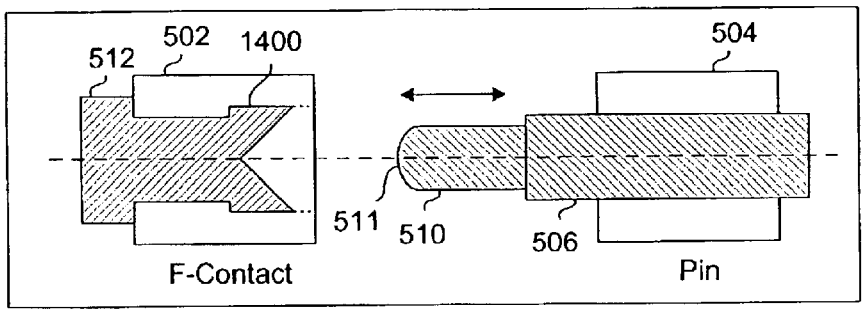
FIG. 14 illustrates a detailed view of an alternative embodiment where the pogo-style pin has the rounded pin head and the female contact has a head designed with a recessed conical concavity.

Referring now to FIG. 14, there is illustrated a detailed view of an alternative embodiment where the pogo-style pin 506 has the rounded tip 511 on the pin head portion 510 and the female contact 512 has a head 1400 designed with a recessed conical concavity. This particular style of head 1400 provides multipoint contact with the surface of the rounded male head tip 511. Again, this is simply to indicate that the disclosed connector system is not limited to the style or design of fixed female contact 512 and pogo pin 506.

Figure 15A:
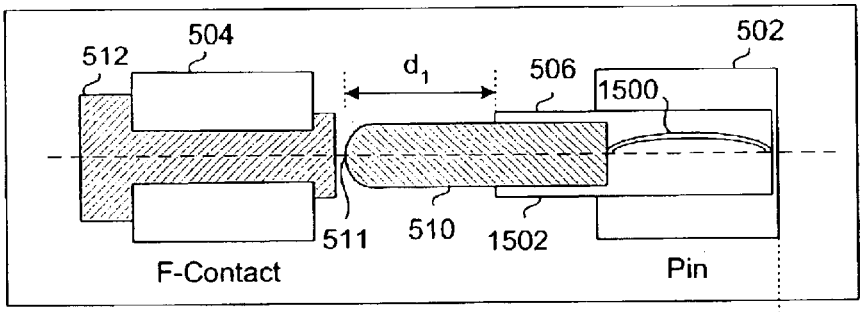
FIG. 15 illustrates positioning of the pin head portion of the pogo pin to the contact from an extended position in FIG. 15*a* to a recoiled position in FIG. 15*b*.
Figure 15B:
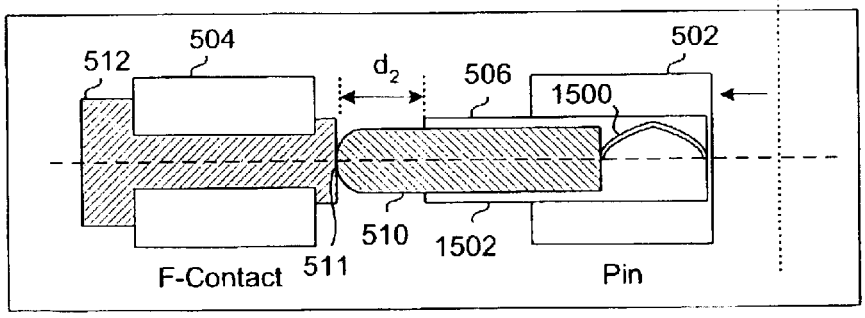

Referring now to FIG. 15, there is illustrated positioning of the pin head portion 510 of the pogo pin 506 to the contact 512 from an extended position in FIG. 15*a* to a recoiled position in FIG. 15*b*. The pin 506 includes a pin resilient member 1500 that forces the pin head portion 510 forward from within a pin shell 1502 of the pin assembly 506. Thus when the connector 502 is not interfaced to the mating connector 504, the tip 511 of the pin head portion 510 is extended a distance $d_1$ from the end of the shell 1502. At this time, the resilient member 1500 is shown in a substantially extended position. In FIG. 15*b*, the male connector 502 is brought into engagement with the female connector 504 causing the pin head portion 510 to recess into the shell 1502. The resilient member 1500 is then placed in a contracted position according to the degree of proximity of the male connector 502 with the female connector 504. Thus when the pin tip 511 is in abutment with the contact 512 and the connectors (502 and 504) in final engagement, the pin head portion 510 extends a distance $d_2$ from the end of the shell 1502.

Figure 16A:
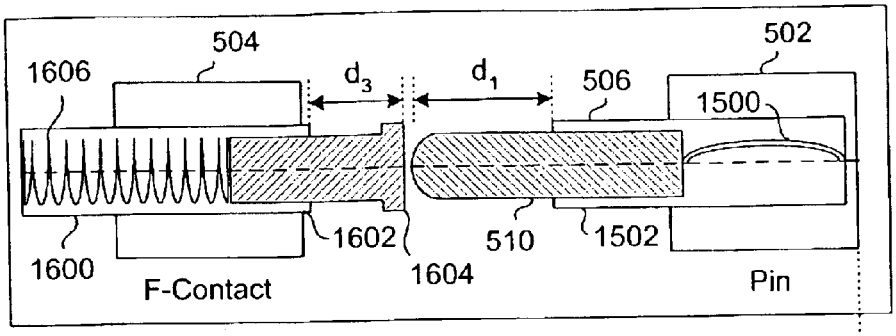
FIG. 16 illustrates positioning of both the pogo-style pin and a pogo-style contact from extended positions in FIG. 16*a* to partially recoiled positions in FIG. 16*b* during full connector engagement.
Figure 16B:
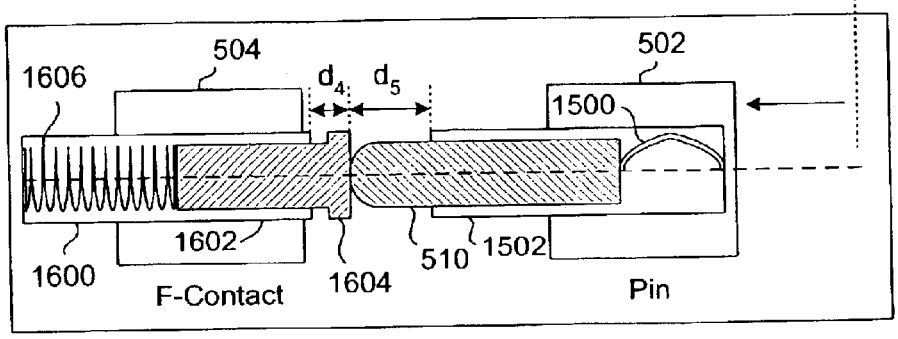

Referring now to FIG. 16, there is illustrated positioning of both the pogo-style pin 506 and a pogo-style contact 1600 from extended positions in FIG. 16*a* to partially recoiled positions in FIG. 16*b* during full connector engagement. The pogo contact 1600 includes a shell 1602 that captures a movable contact head 1604. A contact resilient member 1606, which is a spring in this particular embodiment, provides a steady force to the contact head 1604 to ensure that the contact head 1604 is extended from the shell 1602 a distance $d_3$ when the connectors (502 and 504) are not engaged. Similarly, the pin head portion 510 is extended the distance $d_1$ when the connectors (502 and 504) are not engaged.

When the connectors (502 and 504) are brought into full engagement, and the pin head 510 and contact head 1604 are in abutment, the contact head 1604 recesses back into the contact shell 1602 such that the head 1604 extends a distance $d_4$ from the end of the shell 1602. Accordingly, the pin head portion 510 recesses into the pin shell 1502 such that the pin head 510 extends a distance $d_5$ from the end of the shell 1502. Both the contact member 1606 and the pin member 1500 are now under greater compression during full connector engagement. Moreover, the distances $d_4$ and $d_5$ are determined by the relative strengths of the respective members 1500 and 1606. For example, if the pin member 1500 is stronger than the contact member 1606, the pin member 1500 will "overpower" the contact member to some extent until equilibrium is reached. Thus a reliable, electrically conductive interface is provided between the pin head 510 and the contact 1604.

Figure 17:
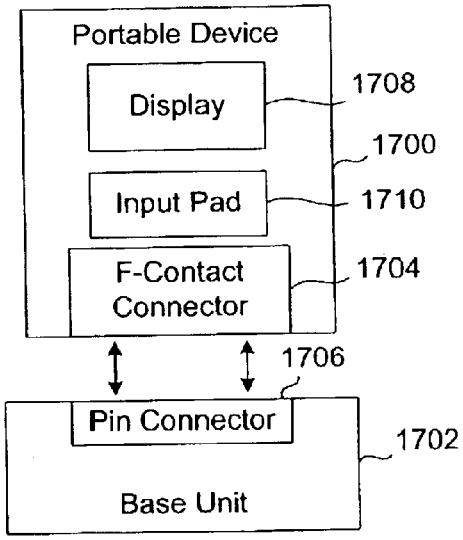
FIG. 17 illustrates a general block diagram of equipment that utilizes the disclosed connector system.

Referring now to FIG. 17, there is illustrated a general block diagram of equipment that utilizes the disclosed connector system. A portable device 1700 and a base unit 1702 interface via the connector system 500. The device 1700 includes a female connector 1704 (similar to connector 504) to accommodate signals and power of the base unit 1702. Accordingly, the base unit 1702 includes a compatible male connector 1706 that utilizes the pogo style of pins 506. Thus when the user removes from or replaces the portable device into the base unit 1702, the female connector 1704 of fixed contacts and the male connector 1706 of pogo-style pins 506 engage to electrically communicate power and/or signals therebetween. Note that the portable device 1700 may include a display 1708 for presenting information to the user, and an input pad 1710 for providing a means for the user to enter information to utilize the device 1700, or configure the device 1700.

Figure 18A:
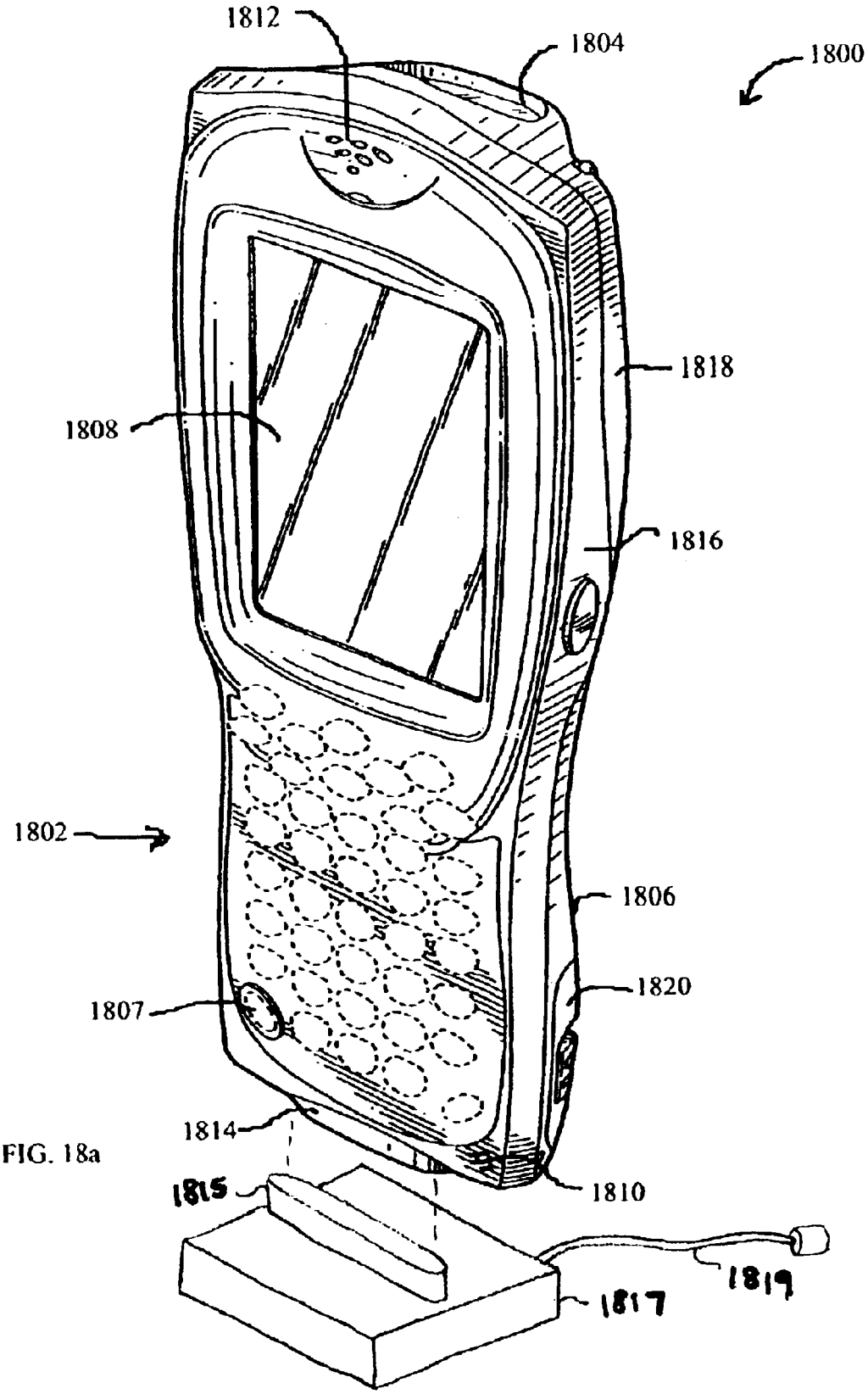
FIG. 18 illustrates front and rear views of a portable terminal device adapted to include the disclosed contact architecture.
Figure 18B:
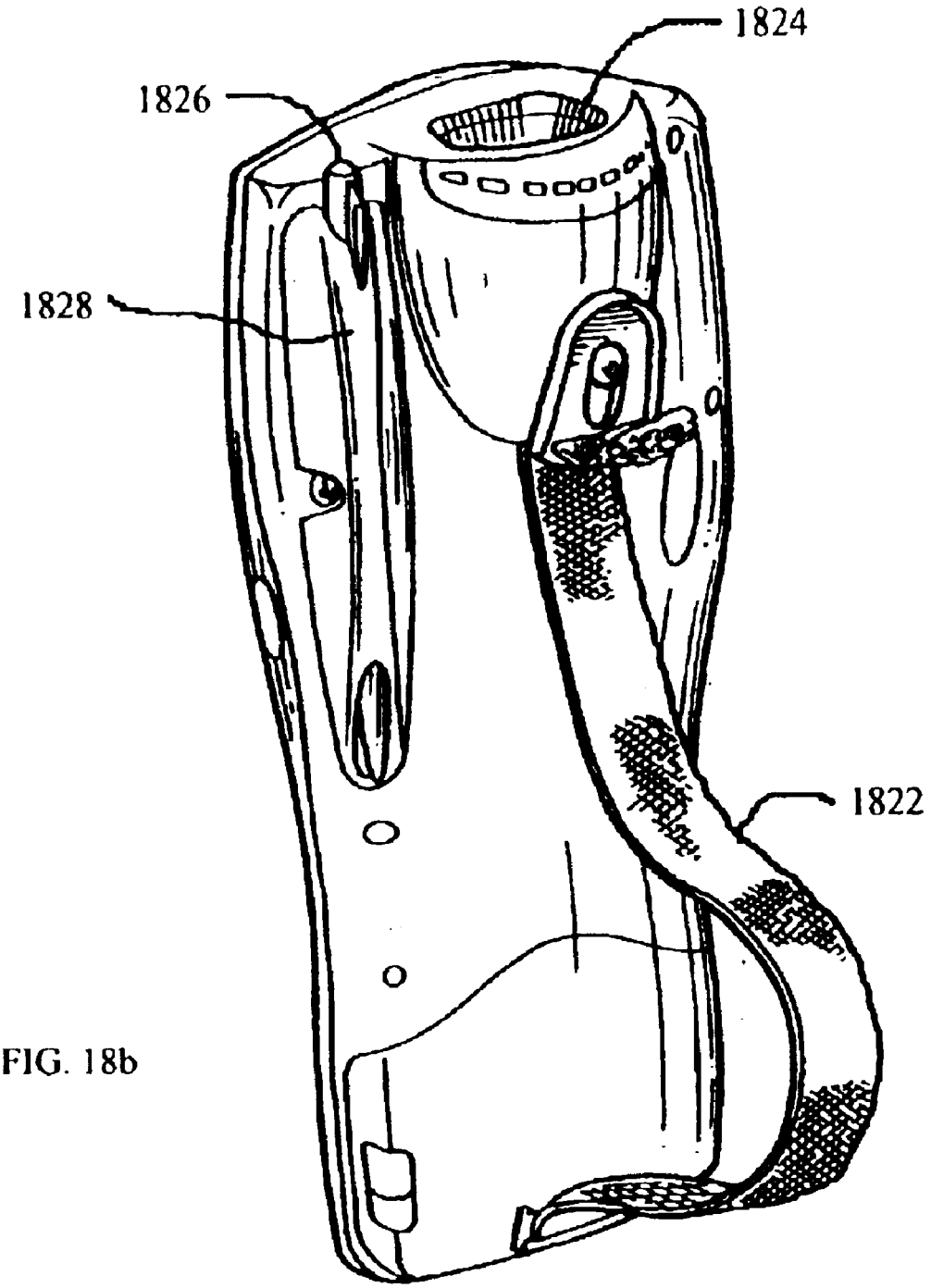

Referring now to FIG. 18, there is illustrated front and rear views of a portable terminal device 1800 (similar to portable device 1700) adapted to include the disclosed contact architecture. FIG. 18*a* is a pictorial representation the front view thereof, and FIG. 18*b* is a pictorial representation of the rear view. In this particular example, the portable electronic device 1800 is a hand-held terminal used in a wireless communication network for tracking inventory, scanning and storing data, etc. The user may manually interface with the device 1800 via a keypad 1802, automatically input data by reading a dataform (not shown) in the format of, e.g., bar code, image, magnetic media with a dataform reading component 1804, the dataform reading component 1804, including, e.g., a bar code scanner/imaging apparatus or magnetic reader, etc., the operation of all which can occur independent of the device 1800 being in operative wired/wireless communication with a network, e.g., a LAN or WAN. When the device 1800 does not include wireless communication capability, e.g., an RF means, to provide for real time communications of data to the LAN/WAN, the data is stored in memory within the device 1800. The memory can take the form non-volatile storage such as a micro-drive disk storage unit, RAM memory, flash memory, etc. When the device 1800 is connected to a LAN/WAN, the stored data can be transmitted to a thereacross to a network storage node, e.g., a network client or server computer (not shown). It is appreciated that the portable device 1800 can also be any other type of device that is portable in nature, and having electronic circuitry therein in accordance with the present invention. For example, the portable device could be a laptop computer, notebook computer, a Personal Data Assistant, cellular telephone, pager, any of which employs an onboard power source, such as batteries.

The device 1800 includes, but is not limited to, the following components: a housing 1806 for providing a ruggedized enclosure in which the device hardware and software are contained; a power button 1807 turning the device on and off; a display 1808 for displaying information to a user, and where the display 1808 is an interactive interface device such as a touch screen display, allowing the user to interact manually to input information and/or operational commands; the keypad 1802 including a set of user interface keys for facilitating to input of information and/or operational commands by the user, the keypad 1802 including full alphanumeric capability, function keys, control keys, etc.; the dataform reading device 1804, e.g., bar code scanner, imager, magnetic medium reader, etc.; a microphone 1810 for receiving audio input; a speaker for providing audio output to the user, whether rudimentary beeps or modulated verbal signals; and, one or more communication ports, either provided separately through the housing 1806, and/or via a mating connector 1814 incorporating the disclosed contact architecture.

The connector 1814 mates to a base connector 1815 of a base station 1817, or other suitable accessory. The connectors (1814 and 1815) may be either a male connector or female connectors utilizing the disclosed contact architecture and arrangement of any of the connectors 502, 504, 600, 704, 706, 800, 802 provided herein. The base station 1817 provides charging power to batteries of the device 1800, and power to operate the device 1800 while in the station 1817, if adapted to do so. The station 1817 is also operable to communicate wirelessly with the portable device 1800 when the device 1800 is disengaged from the station 1817. The station 1817 includes a cable 1819 that accommodates both power and communications. For example, the cable 1819 can be a wired network connection such that data may uploaded/downloaded between a network resource and the device 1800. It is appreciated that other arrangements of the disclosed contact architecture thereof can be incorporated therein. The device 1800 can include a lighting element such as an LED that is illuminated to signal whether or not the dataform has been successfully read.

The housing 1806 is an elongated enclosure of a size and structure that includes contours so as to fit conveniently into the open palm of the user. The housing 1806 may be comprised of a number of mating shell portions such as, for example, a front shell 1816 and rear shell 1818, as well as a battery pack lid 1820.

In FIG. 18*b*, the housing 1806 is illustrated to include a hand strap 1822 for user comfort, and to aid the user in retaining the device 1800 in his or her hand. The device 1800 also includes a window 1824 through which the dataform reader 1804 is able to read the dataform of a label or object presented for reading. To facilitate keypad and/or touch screen use by the user, a pen 1826 is provided in a pen holder 1828.

Of course, other communication interface technologies may be utilized with the disclosed connector system. Popular serial and parallel communication technologies may be utilized, e.g., $I^2C$ (Inter-IC bus), RS-232, USB (Universal Serial Bus), IEEE 1394 (also known as FireWire™).

Although preferred aspects of the invention have been described in detail, it should be understood that various changes, substitutions, and alterations could be made therein without departing from the spirit and scope of the invention as defined by the appended claims.

What is claimed is:

1. A connector interface system of a portable device and an accessory, comprising:

a device connector in a connector housing of the portable device having a first arrangement of one or more pogo contacts to reduce wear during engagement; and an accessory connector on a circuit board of an accessory that mates to the device connector, the accessory connector having a second arrangement of one or more pogo accessory contacts that align with the one or more pogo contacts of the device connector.

2. The system of claim 1, the one or more pogo contacts of the device connector and the one or more accessory contacts interface in tip-to-tip abutment during engagement of the portable device with the accessory.

3. The system of claim 1, the contacts of at least one of the device connector and the accessory connector are plated with a wear-resistant electrically conductive metal, which metal is hard gold.

4. The system of claim 1, the portable device includes at least one of a dataform reading device and a wireless telecommunications device.

5. The system of claim 1, the one or more pogo contacts are in substantially axial alignment with the one or more accessory contacts of the accessory.

6. The system of claim 1, the circuit board includes at least one of a rigid portion and a flexible portion.

7. A method of interfacing a portable device and an accessory, comprising:

providing a device connector in a connector housing of the portable device having a first arrangement of one or more pogo contacts to reduce wear during interaction with mating contacts; and providing an accessory connector on a circuit board of an accessory that mates to the device connector, the accessory connector having a second arrangement of one or more pogo accessory contacts that align with the one or more pogo contacts of the device connector.

8. The method of claim 7, the one or more pogo contacts and the one or more accessory contacts interface in tip-to-tip abutment during engagement of the portable device with the accessory.

9. The method of claim 7, the contacts of at least one of the device connector and the accessory connector are plated with a wear-resistant electrically conductive metal, which metal is hard gold.

10. The method of claim 7, the portable device includes at least one of a dataform reading device and a wireless telecommunications device.

11. The method of claim 7, wherein the one or more pogo contacts are in substantially axial alignment with the one or more accessory contacts of the accessory.

12. The method of claim 7, the circuit board includes at least one of a rigid portion and a flexible portion.

13. A connector interface of an accessory to, the accessory associated with a portable device, the connector interface comprising:

an interface connector having an arrangement of pogo-style contacts to reduce wear during interaction with mating contacts, the arrangement includes a first set of pogo contacts that conduct power and a second set of pogo contacts that conduct signals;

wherein the accessory communicates signals wirelessly with the portable device during disengagement.

14. The interface of claim 13, the pogo contacts are in substantially axial alignment with the mating contacts during engagement of the accessory with the portable device.

15. The interface of claim 13, the arrangement of the pogo-style contacts that interface in tip-to-tip abutment with the mating contacts of the portable device dining engagement.

16. The interface of claim 13, the pogo contacts are plated with a wear-resistant electrically conductive metal, which metal is hard gold.

17. The interface of claim 13, the accessory provides at least one of the power and signals to the portable device during engagement.

18. A method of interfacing to an accessory, the accessory associated with a portable device and comprising:

providing an interface connector having an arrangement of pogo-style contacts to reduce wear during interaction with mating contacts of the accessory, the arrangement includes a first set of pogo contacts that conduct power and a second set of pogo contacts that conduct signals;

wherein the accessory communicates signals wirelessly with the portable device during disengagement.

19. The method of claim 18, the pogo contacts are in substantially axial alignment with the mating contacts during engagement of the accessory with the portable device.

20. The method of claim 18, the arrangement of pogo contacts interface in tip-to-tip abutment with the mating contacts of the portable device during engagement.

21. The method of claim 18, the pogo contacts are plated with a wear-resistant electrically conductive metal, which metal is hard gold.

22. The method of claim 18, the accessory provides at least one of the power and signals to the portable device during engagement.

* * * * *